US005509859A

United States Patent [19]

Klees et al.

[11] Patent Number: 5,509,859

[45] Date of Patent: Apr. 23, 1996

[54] LEASH WITH SOUND

[75] Inventors: Daniel J. Klees, 224 W. Park St., Mundelein, Ill. 60060; Terri Shepherd, Mundelein, Ill.

[73] Assignee: Daniel J. Klees, Mundelein, Ill.

[21] Appl. No.: 496,601

[22] Filed: Jul. 29, 1995

[51] Int. Cl.[6] ..... A63J 5/04

[52] U.S. Cl. ..... 472/64; 446/397; 119/792

[58] Field of Search ..... 446/297, 303, 446/397; 472/57, 64; 119/792

[56] References Cited

U.S. PATENT DOCUMENTS

| | | | |
|---|---|---|---|
| 1,652,382 | 12/1927 | Swisher | 446/397 |
| 1,667,125 | 4/1928 | Majewicz | 446/397 |
| 3,870,296 | 3/1975 | Ellis | 472/57 |
| 4,282,681 | 8/1981 | McCaslin . | |
| 5,145,447 | 9/1992 | Goldfarb | 446/408 |
| 5,316,515 | 5/1994 | Hyman et al. | 446/28 |

FOREIGN PATENT DOCUMENTS

| | | | |
|---|---|---|---|
| 791389 | 12/1980 | U.S.S.R. | 446/303 |

*Primary Examiner*—Mickey Yu
*Attorney, Agent, or Firm*—Dick And Harris

[57] ABSTRACT

A novelty item for creating the illusion of an imaginary pet including a hollow, elongated leash with a handle at one end and a collar and harness adjacent the other end. Housed within the handle, which is hollow, is a battery power source and an integrated circuit for producing a plurality of animal sounds. Also carried by the handle are an on/off switch and at least one selector switch for the sound circuitry. Mounted within the collar end of the leash is a micro speaker which is connected by wiring through the hollow leash to the circuitry in the handle.

8 Claims, 1 Drawing Sheet

ON
OFF

LEASH WITH SOUND

BACKGROUND OF THE INVENTION

1. Field of the Invention

This invention relates generally to novelty items and more particularly to novelty items simulating an imaginary pet.

2. Background Art

A novelty item exists in the prior art, such as is shown in Ellis U.S. Pat. No. 3,870,296 issued Mar. 11, 1975, in which a rigid, simulated leash supporting a simulated harness at one end is held and manually controlled at the opposite end by a user to create the impression that an invisible or imaginary dog, or some other animal, is on the leash. Persons having a degree of imagination and aptitude can, by controlling the held end of the rigid leash, simulate walking the imaginary pet, having the imaginary pet jumping, moving from side to side, or attempting to pull away from the person. However, notwithstanding such users' imagination and aptitude, it is desirable to be able to otherwise create the impression that an invisible animal is actually contained within the harness.

It is long been known in the toy and novelty art that sounds may be created within a doll, simulated animal, or other character, either mechanically or electronically, to create an impression, by appropriate sounds, of crying, calling for a parent, barking, mooing, screaming or the like. An example of the use of an electronic sound producing device within a toy or novelty item is shown in Hyman et al. U.S. Pat. No. 5,316,515 which issued May 31, 1994. That patent discloses a neck and head portion of a hobby horse attached to a user's waist by a belt. A sound producing circuit, including a battery power system, a speaker and a sound synthesizing circuit coupled to various switches for providing a plurality of sound outputs, is contained within and completely obscured by the head and neck of the hobby horse. Thus, it appears that the sounds produced by the circuit emanate from within the hobby horse. There remains, however, a need for a novelty item which uses sound for enhancing the illusion created by the novelty item where the bulk of a doll, animal or character is not available to obscure the mechanism.

SUMMARY OF THE INVENTION

The present invention is concerned with providing a novelty item for creating the illusion of an imaginary pet, both visually and by sound, including an elongated, hollow leash member having opposed ends. Adjacent one end of the leash member is a handle with a collar adjacent the other end. A speaker is carried adjacent the end of the leash opposite the handle and is obscured from view. Electronic sound producing circuitry, including a battery power source, is carried by the handle. Wiring connecting the sound producing circuitry and the speaker is carried within the hollow leash member. The handle carries switches for manually actuating the sound producing circuitry. In addition to the collar, a simulated harness may be mounted to the leash adjacent the collar.

The electronic circuitry may produce a plurality of sounds and the handle then carries one or more selector switches for the user's choice of a particular sound.

The handle is secured to the leash member to prevent longitudinal or rotational displacement which could be detrimental to the electrical wiring connection. A replaceable battery power source is carried inside the hollow handle. A removable cap is provided for access to the interior of the handle for replacement of the battery power source.

BRIEF DESCRIPTION OF THE DRAWINGS

For a better understanding of the present invention, reference may be had to the accompanying drawings in which.

DETAILED DESCRIPTION

Figures 1, 2, 3, 4:
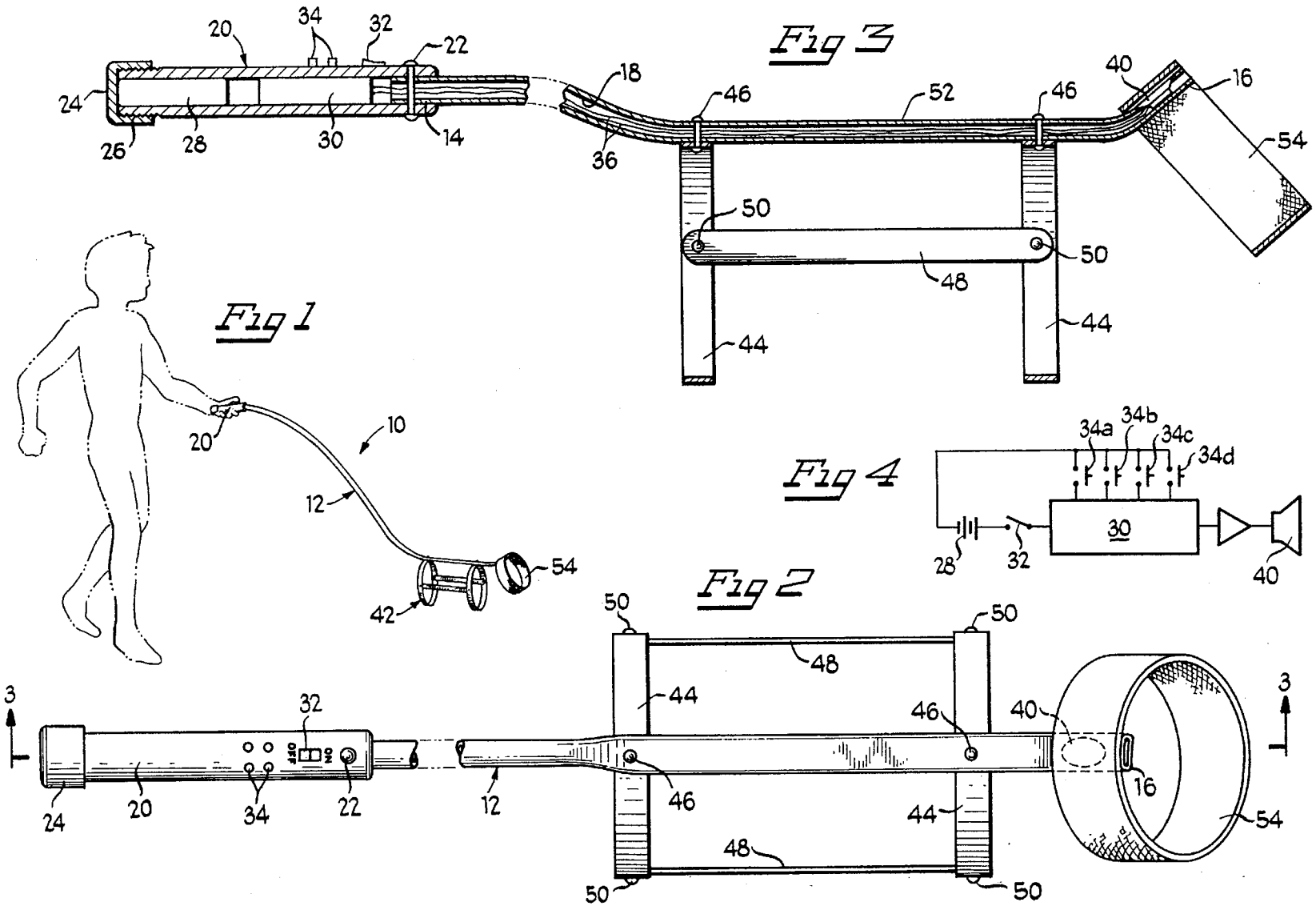
FIG. 1 is a perspective view of an embodiment of the present invention.
FIG. 2 is a enlarged scale, top plan view of the present invention with a mid-portion of the leash omitted for ease of illustration.
FIG. 3 is a sectional view taken generally along line 3—3 of FIG. 2.
FIG. 4 is a schematic of a circuit of the present invention.

Referring now to the drawings in which like parts are designated by like reference numerals throughout the several views, there is shown in FIG. 1 a novelty item 10 including a relatively rigid, elongated, hollow leash member 12 having a held end 14 and a free end 16.

Leash 12 is generally cylindrical in cross section with a hollow interior 18, which is best shown in FIG. 3, and may be made of a plastic material by extrusion. While somewhat flexible, leash 12 is sufficiently rigid to maintain a preformed shape such as that illustrated in FIG. 1. Alternatively, leash 12 may be formed of a hollow, more flexible material, such as braided plastic rope, with a preformed bent wire in the hollow interior to provide form and a degree of rigidity to the leash.

At held end 14, leash 12 is secured to a hollow handle 20 by a rivet 22 or the like. Alternatively, leash 12 may be secured to handle 20 by an adhesive, as long as leash 12 and handle 20 are prevented from being substantially displaced along their longitudinal axes and are prevented from rotating relative to each other. Opposite the attachment to leash 12, hollow handle 20 is provided with a removable cap 24. Particularly if handle 20 is generally cylindrical, cap 24 may be removeably attached to the handle by cooperating threads 26 formed on the exterior surface of handle 20 and the interior surface of cap 24. Other alternatives for removeably attaching a cap to a hollow handle, such as are used in various flashlights, may also be used. Housed within hollow handle 20 are a conventional battery 28 and an integrated circuit or chip 30. Operably disposed on the outer surface of handle 20 are an on/off switch 32 and a plurality of selector switches 34. Each of the switches is operably connected to other circuit elements as shown in the schematic of FIG. 4. Wires 36 extending through hollow interior 18 of leash 12 electrically connect integrated circuit 30 to a micro speaker 40.

Proximate free end 16 of leash 12 is a harness 42 simulating the type of harness used for pet dogs or cats. Harness 42 includes a pair of depending body strap loops 44, each of which is attached to leash 12 by a rivet 46, or the like. In addition, lateral bands 48 extend on each side between strap loops 44 and are secured to the loops by rivets 50. As is best illustrated in FIG. 2, a portion 52 of leash 12 that is proximate free end 16 is flattened from the generally cylindrical shape of the rest of the leash such that portion 52 forms an upper strap of harness 42. However, portion 52 is not so flattened as to preclude housing wires 36 from passing through the leash.

Attached adjacent free end 16 of leash 12 is a collar 54 that is conveniently wide enough to hide micro speaker 40. Each of body strap loops 44 and collar 54 are preferably formed of a relatively rigid material such that they generally maintain the shape they would have if they were flexible or resilient and were secured about an animal.

As is best illustrated in FIG. 3, micro speaker 40 may be further obscured by positioning it within flattened leash 12 immediately inside free end 16. Micro speaker 40 may be positioned with the speaker directed towards the outer, upper portion of collar 54 as is shown in FIG. 3 or alternatively may be reversed to direct the speaker output downwardly into the collar.

As is schematically shown in FIG. 4, micro speaker 40 is connected to micro processor or integrated circuit 30 which includes a conventional sound producing circuit for a plurality simulated synthetic animal sounds such as a friendly dog bark, a mean dog growl, a friendly cat meow, and a scary cat hiss. A selected one of such sounds, which the user may select by depressing an appropriate one of selector switches 34*a*, 34*b*, 34*c* or 34*d*, is then played through micro speaker 40. As an alternative to having a plurality of selector switches 34, a single selector switch may be provided which the user depresses a pre-determined number of times in order to make the selection. The schematic circuit shown in FIG. 4 would then be modified to include a conventional resetable register to count the number of times the selector switch is depressed in order to make the appropriate sound selection.

While a particular embodiment of the invention has been shown and described with some suggested alternatives, further variations and modifications will occur to those skilled in the art. It is intended in the appended claims to cover all such variations and modifications as come within the true spirit and scope of the present invention.

What is claimed as new and desired to be secured by Letters Patent is:

1. A novelty item comprising:

an elongated, hollow member having opposed ends;

a handle adjacent one end of the member;

a collar adjacent the other end of the member opposite the handle;

a speaker carried adjacent the end of the member opposite the handle;

means obscuring the speaker from view;

electronic sound producing circuitry carried by the handle;

a battery power source;

means for electrically connecting the sound producing circuitry and the speaker carried within the elongated member and obscured from view; and means for manually actuating the sound producing circuitry carried by the handle.

2. The novelty item of claim 1 in which the speaker is mounted within the elongated member to obscure it from view.

3. The novelty item of claim 1 in which the collar obscures the speaker from view.

4. The novelty item of claim 1 further comprising a simulated harness for an animal mounted to the member adjacent the collar.

5. The novelty item of claim 1 in which the electronic circuitry produces a plurality of sounds and means for manual selection of individual ones of the plurality of sounds carried by the handle.

6. The novelty item of claim 1 in which the handle is secured to the one end of the member to prevent substantially longitudinal or rotational displacement.

7. The novelty item of claim 6 in which:

the handle is hollow; and the battery power source is carried inside the handle.

8. The novelty item of claim 7 in which the handle is provided with a removable cap for access to the battery power source.

* * * * *

UNITED STATES PATENT AND TRADEMARK OFFICE

CERTIFICATE OF CORRECTION

PATENT NO. : 5,509,859

DATED : April 23, 1996

INVENTOR(S) : Daniel J. Klees, Terri Shepherd (Klees et al.)

It is certified that error appears in the above-indentified patent and that said Letters Patent is hereby corrected as shown below:

On the Title page, Item [22] Delete "Jul. 29, 1995" and insert instead --June 29, 1995--.

Signed and Sealed this

Sixth Day of August, 1996

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,509,859

DATED : April 23, 1996

INVENTOR(S) : Daniel J. Klees, Terri Shepherd (Klees et al.)

It is certified that error appears in the above-indentified patent and that said Letters Patent is hereby corrected as shown below:

Title Page, Item [54] Title Delete "LEASH WITH SOUND" and insert instead -- NOVELTY LEASH WITH SOUND --.

Signed and Sealed this

Eighth Day of October, 1996

*Attest:*

Bruce Lehman

BRUCE LEHMAN

*Attesting Officer*

*Commissioner of Patents and Trademarks*